US006227392B1

(12) United States Patent
Balzeau

(10) Patent No.: US 6,227,392 B1
(45) **Date of Patent: *May 8, 2001**

(54) GLASS OR CERAMIC BOTTLE COMPRISING AN ATTACHED ELEMENT

(75) Inventor: Pascal Balzeau, Chevilly-Larue (FR)

(73) Assignee: L'Oreal, Paris (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/158,783

(22) Filed: Sep. 23, 1998

(30) Foreign Application Priority Data

Sep. 26, 1997 (FR) ..... 97 12019

(51) Int. Cl.[7] ..... B65D 39/00
(52) U.S. Cl. ..... 215/364; 222/321.7
(58) Field of Search ..... 220/256, 254; 215/364, 296, 294, 355, 329, 247, 567, 321.7; 222/321.1, 321.7, 544, 545, 546, 562, 563

(56) References Cited

U.S. PATENT DOCUMENTS

| | | | | |
|---|---|---|---|---|
| 3,143,255 | * | 8/1964 | Leeds | 222/479 |
| 3,814,276 | * | 6/1974 | Van Gordon et al. | 220/256 |
| 3,830,413 | * | 8/1974 | Birrell | 222/563 |
| 4,140,235 | * | 2/1979 | Rausing et al. | 215/356 |
| 4,165,350 | | 8/1979 | Greenberg . | |
| 4,569,457 | * | 2/1986 | Hatakeyama et al. | 215/364 |
| 4,645,096 | * | 2/1987 | Grant | 222/563 |
| 4,708,260 | * | 11/1987 | Siegal et al. | 222/542 |
| 5,275,299 | * | 1/1994 | Konrad et al. | 215/356 |
| 5,447,247 | * | 9/1995 | Derksen | 215/247 |
| 5,515,991 | * | 5/1996 | Heitland | 220/256 |
| 5,522,518 | * | 6/1996 | Konrad et al. | 215/364 |
| 5,642,908 | * | 7/1997 | Mascitelli | 222/321.7 |
| 5,772,078 | * | 6/1998 | Knickerbocker | 222/321.1 |
| 5,799,836 | * | 9/1998 | Lee | 222/567 |
| 5,833,928 | * | 11/1998 | Ratajczak et al. | 220/254 |

FOREIGN PATENT DOCUMENTS

| | | |
|---|---|---|
| 2 237 269 | 5/1991 | (GB) . |
| WO 88/.02297 | 4/1988 | (WO) . |
| WO 98/13267 | 4/1998 | (WO) . |

* cited by examiner

*Primary Examiner*—Pascal Balzeau
(74) *Attorney, Agent, or Firm*—Oblon, Spivak, McClelland, Maier & Neustadt, P.C.

(57) ABSTRACT

A bottle (1) consists of a closed body (2) made of glass or ceramic material, surmounted by a shoulder (4) delimiting an orifice (5) in a plane substantially level with the shoulder (4). The bottle has an attached element (7) which is made of a material of a different type from the material forming the bottle and is mounted in the orifice in a leak-tight manner and which has a portion (13) emerging outside the bottle substantially beyond the plane of the orifice, in order to receive in a leak-tight manner a closing element (15) and/or an element (25) for dispensing a product contained in the bottle. The attached element has a duct (9) communicating with the bottle and opening, outside the bottle, onto an outlet port (10).

23 Claims, 2 Drawing Sheets

GLASS OR CERAMIC BOTTLE COMPRISING AN ATTACHED ELEMENT

BACKGROUND OF THE INVENTION

1. Field of the Invention

The present invention relates to a bottle made of glass, especially quartz glass or crystal glass, or a ceramic material (earthenware, porcelain, some glasses, etc.), intended, in particular, for the packaging and dispensing of cosmetic products, such as perfumes.

2. Background of the Related Art

Most perfumes are packaged in glass bottles which are typically obtained by blowing or by molding. Such bottles typically comprise a closed body which is surmounted by a neck connected to the body via a shoulder and delimiting an orifice allowing the product to emerge. The neck may have a thread on its outer surface, the thread being capable of cooperating with the internal thread of a stopper. Alternatively, a pump or valve capable of being actuated by a push button is mounted, especially by crimping, on the neck. For this purpose, a bead is provided in the vicinity of the orifice delimited by the neck so as to allow the pump or valve to be crimp-fitted. Alternatively, the pump or valve may be mounted on the neck via an intermediate element which is force-fitted into the neck of the bottle, in which case the force-fitting of the intermediate element embrittles the neck and prevents very tight fitting.

Some glass bottles, on at least part of their surface, have cut and polished facets or other reliefs which improve the aesthetic appearance of the bottle. Such facets, made typically by a cutting wheel, may be located especially on the shoulder in the vicinity of the neck, in which case the neck is unavoidably ground or broken by the tools used for carrying out the various operations in the desired locations. The neck may subsequently be rebonded so as to allow a stopper or a pump to be fitted. However, the bottle is brittle in the region of the bonding zone. Moreover, adhesive, in addition to deteriorating over a period of time, may interact with the product contained in the bottle and so may appreciably impair the properties of the product.

EP-A-079,275 and EP-A-0,186,548 describe adaptor assemblies intended especially to be mounted on glass bottles of the neck type, for example in order to receive a stopper. Such assemblies are composed of two parts and require the presence of a neck in order to be mounted. Furthermore, the cost of this two-part adaptor increases the cost of the bottle substantially. Finally, because of their configuration, these adaptor assemblies do not permit the fitting of a threaded stopper or a pump or, at least, require a supplementary mounting part.

Such products may also be contained in bottles made of ceramic, especially porcelains, earthenwares or some glasses. The bottle undergoes various treatments, especially baking or enamelling, allowing it to be made leak-tight or for decorative purposes. These operations, especially baking, may slightly change the dimensional characteristics of the bottle, in particular in the region of the neck, these changes making it difficult to mount a screwed or force-fitted stopper or a pump so as to be leak-tight.

SUMMARY OF THE INVENTION

One object of the invention, therefore, is to make it possible to produce a bottle, especially made of glass or ceramic, which does not have the disadvantages discussed above.

Another object of the invention is to provide a bottle using materials such as those described above, the bottle being capable of undergoing, in particular in the vicinity of the orifice delimited by the shoulder, a treatment which is especially mechanical (cutting, polishing, grinding) or thermal (baking), a closing and/or dispensing device being mounted on the bottle in an absolutely leak-tight manner.

According to the invention, these and other objects are achieved by providing a bottle from glass or ceramic material, which comprises a body having a bottom and surmounted by a shoulder delimiting an orifice in a plane substantially level with the shoulder, an attached element made of a material of a different type from the material forming the bottle being mounted in the orifice in a leak-tight manner in order to receive in a leak-tight manner a closing element and/or an element for dispensing a product contained in the bottle, and the attached element having a duct communicating with the bottle and opening, outside the bottle onto an outlet port.

Advantageously, especially when a screwed stopper or a pump is to be mounted, the attached element has a portion which emerges outside the bottle substantially beyond the plane of the orifice. The bottom may form one piece with the body or be formed from an attached part made, for example, of thermoplastic. The orifice may be located in the axis of the bottle or be offset.

A bottle, especially made of glass, is thus produced, the aesthetic appearance of which may be selected as desired and which has an attached element which is capable of forming a neck and is mounted in an absolutely leak-tight manner without resulting in a zone of brittleness, and on which any type of closing-off and/or dispensing means may be mounted. The mounting of the attached part does not require the use of adhesive which may deteriorate or be detrimental to the properties of the product which the bottle contains. Moreover, if the attached element is force-fitted, the stresses associated with this type of fitting are exerted on the shoulder which forms a substantially stronger zone than a glass neck. Advantageously, the attached element is force-fitted into the orifice delimited by the shoulder.

The bottle may be made of glass, especially a crystal glass or quartz glass, and at least the shoulder of the bottle has cut facets or other reliefs.

The attached element may be made of thermoplastic, such as a polypropylene, polyethylene, polyethylene terephthalate, etc. It may be covered with a metal or plastic cladding over at least part of the height of the portion emerging from the bottle. This characteristic is particularly suitable for the stoppering described with reference to the third embodiment described below.

Advantageously, the attached element has, on its outer surface, a shoulder or bead capable of limiting the penetration of the element when the element is being inserted into the orifice of the bottle.

According to a first embodiment, the attached element comprises, on the outer surface of the portion emerging from the bottle, a thread capable of co-operating with a corresponding thread of a closing and/or dispensing element.

According to a second embodiment, the portion emerging from the bottle has a free end, the free end forming an annular bead so as to allow the crimp-fitting of a pump or valve controlled by an actuating means in the form of a push button. The assembly may subsequently be covered by a removable cap.

According to a third embodiment, the bottle comprises a stopper having a central portion which is capable of being inserted in a leak-tight manner inside the duct through the outlet port. The stopper may be made of metal, the central portion advantageously being covered, over at least part of its height, by a thermoplastic sheathing capable of improving the leak-tightness relative to the duct formed in the attached element.

The product may be a cosmetic product, especially a perfume.

BRIEF DESCRIPTION OF THE DRAWINGS

Apart from the arrangements described above, the invention includes other arrangements which will be explained below in relation to non-limiting embodiments described with reference to the accompanying drawings in which.

DETAILED DESCRIPTION OF THE PREFERRED EMBODIMENTS

Figure 1:
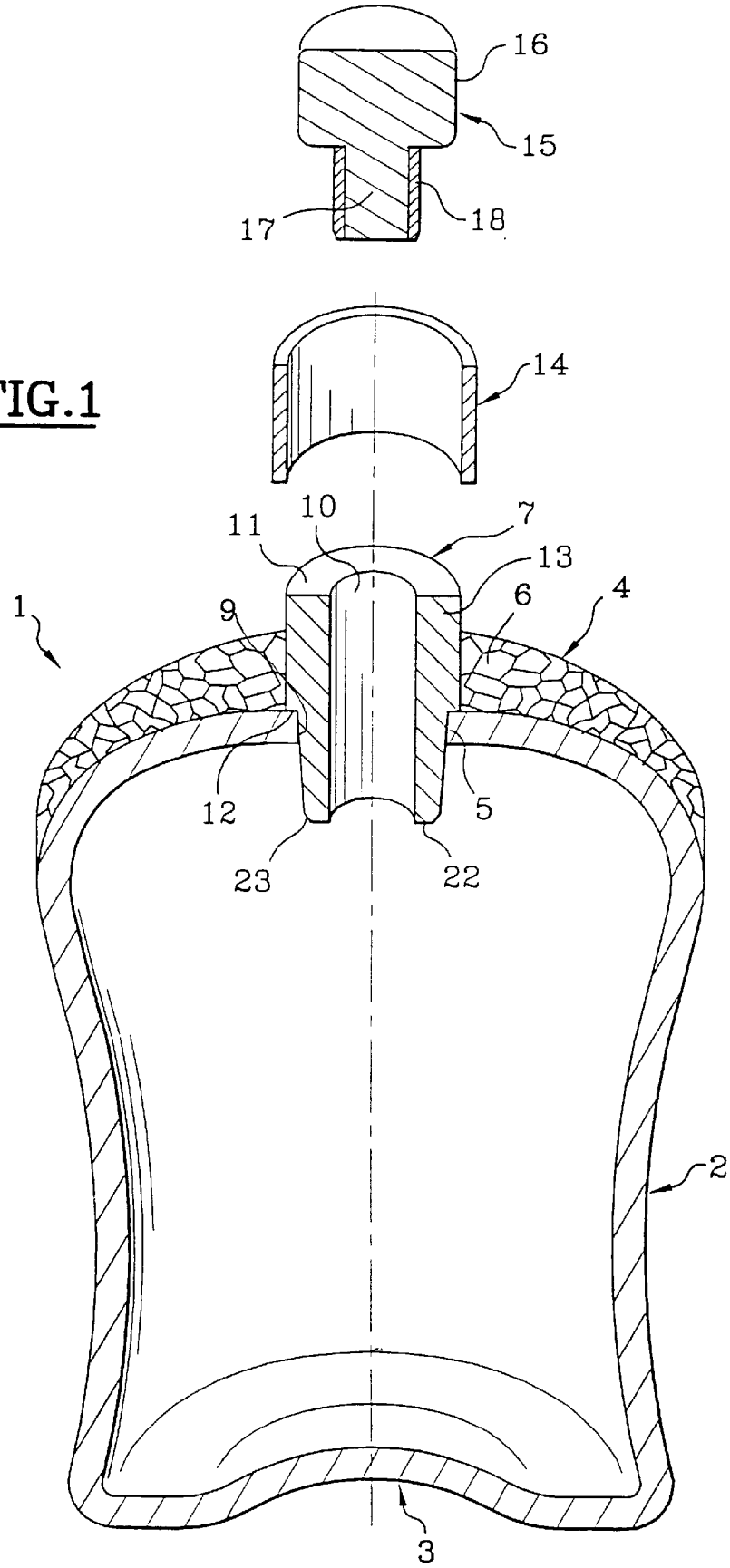
FIG. 1 is an exploded cutaway perspective view of a first embodiment of the bottle according to the invention.

The bottle 1 illustrated in FIG. 1 is produced from crystal glass and comprises a body 2 closed by means of a bottom 3, the body being surmounted by a substantially flat shoulder 4 delimiting an orifice 5 located level with the shoulder. The bottle is produced conventionally by blowing and is subsequently cut, especially over the entire surface formed by the shoulder 4, so as to form facets 6, the number, shape and dimensions of which are selected according to the desired aesthetic appearance. The facets are subsequently polished. The neck, which is initially present on the bottle and originates from the blowing operation, is removed during the operation of cutting the facets 6. Such facets may also be produced in the vicinity of the bottom 3.

If the bottle is obtained by molding pressed glass, the body is closed by an attached bottom which is made, for example, of thermoplastic and which may be force-fitted into an orifice delimited by the lower edge of the body.

An attached element 7 is force-fitted into the orifice 5, after the lapping of the orifice. The attached element 7 takes the form of an annular element through which passes a duct 9 of constant cross-section, opening outside the bottle, onto a port 10 delimited by a first free edge 11 of the attached element 7 and, inside the bottle, onto a port 22 delimited by a second free edge 23 of the element 7. A shoulder 12 is formed by the outer surface of the element 7, substantially at mid-height of the element, so as to form an abutment capable of limiting the penetration of the element 7 into the orifice 5.

The element 7 is obtained by the molding of thermoplastics such as polypropylene or polyethylene. Yet other materials may be used.

As an example, the element 7 has an axial height of from 10 to 20 mm. The thickness of the wall of the shoulder in the region of the orifice 5 is of the order of 5 to 7 mm. The part 13 emerging from the bottle has an axial height varying from 3 mm to 10 mm, depending on the stoppering and/or dispensing device to be mounted on the bottle. The walls of the attached element, especially at the part emerging from the bottle, may have a thickness which may go up to 5 mm. As compared with the thicknesses of the necks of conventional glass bottles, such a thickness allows a firmer and more leak-tight mounting of the closing-off element or of the dispensing element. This is particularly advantageous when the closing-off element is force-fitted into the duct of the attached element.

A cladding 14 is provided so as to cover substantially the entire emerging part of the element 7. This cladding may be made of metal or plastic and be retained on the element 7 by adhesive bonding, catch engagement or self-clamping fitting.

A stopper 15 is provided to close the port 10 delimited by the element 7. In this version, the stopper comprises an upper part 16 serving as a grip member and a lower part 17 of a diameter such that this part may be force-fitted into the duct 9. According to a particular embodiment, the stopper is produced from metal, the part of smaller diameter being covered by a plastic sheathing 18 capable of improving leak-tightness when the stopper is closed. It should be noted that, in this embodiment, because of the way in which this stopper is fitted, there is no need for the attached element to emerge substantially from the bottle.

Figure 2:
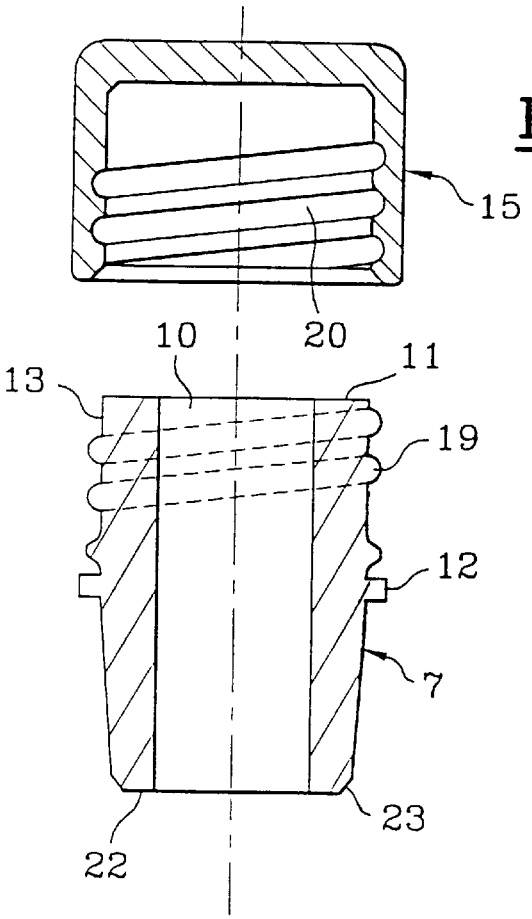
FIG. 2 illustrates a second embodiment according to the invention.

In the embodiment illustrated in FIG. 2, the attached element 7 has a slightly different form. In fact, in this embodiment, the emerging portion 13 located above the bead 12, has over part of its outer surface, a thread 19 capable of co-operating with an internal thread 20 provided on the stopper 15. The bottle itself, not shown, is identical to that discussed with reference to FIG. 1.

Figure 3:
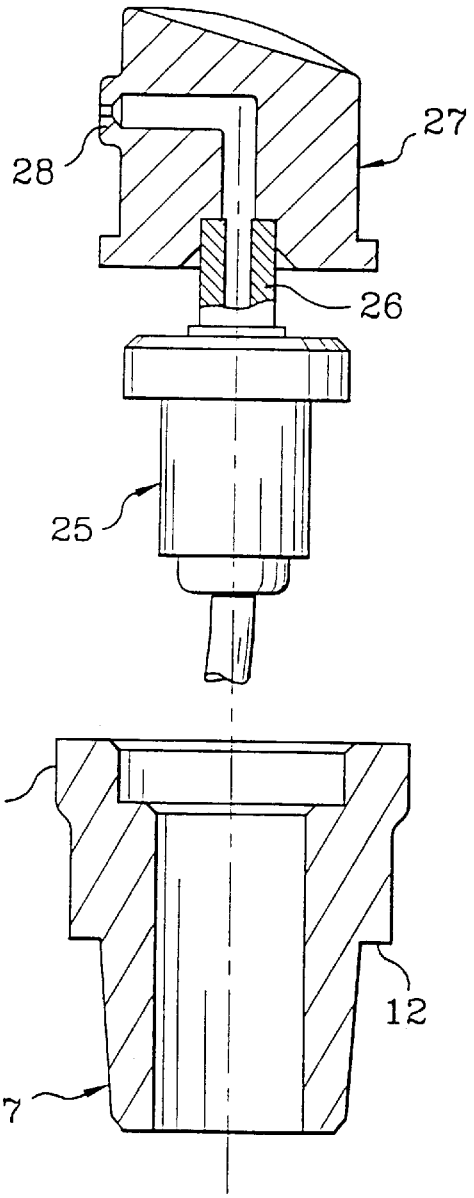
FIG. 3 illustrates a third embodiment of the invention.

In the embodiment of FIG. 3, the free edge 11 forms a bead 24 capable of allowing a pump or valve 25 to be crimp-fitted by means of a crimping collar which is not shown. The pump is surmounted by an emerging stem 26 mounted on elastic return means and intended for receiving a push button 27 having an outlet port 28. A protective cap (not shown) may subsequently be mounted removably in order to protect the push button.

The foregoing detailed description referred to preferred embodiments of the invention. It is clear that the latter may acquire variants, without departing from the spirit of the invention, as claimed hereafter.

What is claimed is:

1. A bottle comprising:

a body made of glass or ceramic material, the body defining a volume for a product and being surmounted by a shoulder at which the body constricts and delimiting an orifice located in a plane substantially level with the shoulder;

an attached element made of a material having a composition which is different from the material forming the body and fluid tightly mounted in the orifice in a leak-tight manner, said attached element having a duct communicating with the volume of the body and forming, outside the bottle, an outlet port; and a closing element mounted to said attached element for closing said outlet port.

2. The bottle according to claim 1, wherein the attached element is force-fitted into said orifice.

3. The bottle according to claim 1, wherein the body is made of glass, and at least said shoulder has cut reliefs.

4. The bottle according to claim 1, wherein said attached element is made of thermoplastic.

5. The bottle according to claim 4, wherein the thermoplastic is one of a polypropylene, polyethylene and polyethylene terephthalate.

6. The bottle according to claim 1, wherein said attached element has an external shoulder or bead capable of limiting penetration of the attached element into the orifice.

7. The bottle according to claim 1, wherein the attached element has a portion emerging from the bottle substantially beyond a plane of the orifice.

8. A bottle according to claim 7, including a cladding covering said attached element over at least part of the height of the portion emerging from the bottle.

9. The bottle according to claim 1, wherein said closing element comprises a stopper, a central portion of said stopper being fittable in a leak-tight manner inside the duct of said attached element.

10. The bottle according to claim 9, wherein the stopper is made of metal, the central portion thereof being at least partially covered by a thermoplastic sheathing capable of improving leak-tightness.

11. A bottle, comprising:

a body made of glass or ceramic material, the body defining a volume for a product and being surmounted by a shoulder delimiting an orifice located in a plane substantially level with the shoulder;

an attached element made of a material different from the material forming the bottle and fluid tightly mounted in the orifice in a leak-tight manner, said attached element having a duct communicating with the volume of the body and forming, outside the bottle, an outlet port; and a dispensing element mounted at said outlet port for dispensing a product contained in the bottle.

12. The bottle according to claim 11, wherein the attached element is force-fitted into said orifice.

13. The bottle according to claim 11, wherein the body is made of glass, and at least said shoulder has cut reliefs.

14. The bottle according to claim 11, wherein said attached element is made of thermoplastic.

15. The bottle according to claim 14, wherein the thermoplastic is one of a polypropylene, polyethylene and polyethylene terephthalate.

16. The bottle according to claim 11, wherein said attached element has an external shoulder or bead capable of limiting penetration of the attached element into the orifice.

17. The bottle according to claim 11, wherein the attached element has a portion emerging from the bottle substantially beyond a plane of the orifice.

18. A bottle according to claim 17, including a cladding covering said attached element over at least part of the height of the portion emerging from the bottle.

19. The bottle according to claim 17, wherein the attached element has, on the outer surface of the portion emerging from the bottle, a thread capable of cooperating with a corresponding thread of the dispensing element.

20. The bottle according to claim 17, wherein the portion emerging from the bottle has a free end forming an annular bead.

21. The bottle according to claim 7, wherein the attached element has, on the outer surface of the portion emerging from the bottle, a thread capable of cooperating with a corresponding thread of the closing element.

22. A bottle comprising:

a body made of glass or ceramic material, the body defining a volume containing a cosmetic product and being surmounted by a shoulder at which the body constricts and delimiting an orifice located in a plane substantially level with the shoulder;

an attached element made of a material having a composition which is different from the material forming the body and fluid tightly mounted in the orifice in a leak-tight manner, said attached element having a duct communicating with the volume of the body and forming, outside the bottle, an outlet port; and a closing element mounted to said attached element for closing said outlet port.

23. A bottle comprising:

a body made of glass or ceramic material, the body defining a volume containing a perfume product and being surmounted by a shoulder at which the body constricts and delimiting an orifice located in a plane substantially level with the shoulder;

an attached element made of a material having a composition which is different from the material forming the body and fluid tightly mounted in the orifice in a leak-tight manner, said attached element having a duct communicating with the volume of the body and forming, outside the bottle, an outlet port; and a closing element mounted to said attached element for closing said outlet port.

* * * * *